US010370807B2

(12) United States Patent
Stevens et al.

(10) Patent No.: US 10,370,807 B2
(45) Date of Patent: Aug. 6, 2019

(54) COLLAPSIBLE PERIMETER BARRICADE

(71) Applicant: OFF THE WALL PRODUCTS, LLC, Salt Lake City, UT (US)

(72) Inventors: Eric M. Stevens, Salt Lake City, UT (US); Leo F. Stanko, Salt Lake City, UT (US); Mark A. Stevens, San Diego, CA (US); Nevin J. Zimmerly, Applecreek, OH (US); Dennis Kovach, Wooster, OH (US)

(73) Assignee: Off The Wall Products, LLC, Salt Lake City, UT (US)

( * ) Notice: Subject to any disclaimer, the term of this patent is extended or adjusted under 35 U.S.C. 154(b) by 0 days.

(21) Appl. No.: 15/815,573

(22) Filed: Nov. 16, 2017

(65) Prior Publication Data

US 2018/0135262 A1 May 17, 2018

Related U.S. Application Data

(60) Provisional application No. 62/423,685, filed on Nov. 17, 2016.

(51) Int. Cl.

| | |
|---|---|
| ***E01F 13/12*** | (2006.01) |
| ***E01F 15/00*** | (2006.01) |
| ***E01F 9/529*** | (2016.01) |
| ***E01F 9/506*** | (2016.01) |
| ***E01F 13/02*** | (2006.01) |
| ***F41H 11/08*** | (2006.01) |

(52) U.S. Cl.

CPC ..... *E01F 13/12* (2013.01); *E01F 9/506* (2016.02); *E01F 9/529* (2016.02); *E01F 13/02* (2013.01); *E01F 15/006* (2013.01); *F41H 11/08* (2013.01); *E01F 13/024* (2013.01)

(58) Field of Classification Search

CPC ..... E01F 13/12
USPC ..... 404/6
See application file for complete search history.

(56) References Cited

U.S. PATENT DOCUMENTS

| | | | | |
|---|---|---|---|---|
| 4,318,079 | A * | 3/1982 | Dickinson | E01F 13/123 116/52 |
| 4,624,210 | A | 11/1986 | Glass | |
| 4,974,815 | A | 12/1990 | Glass | |
| 5,829,912 | A * | 11/1998 | Marcotullio | E01F 13/024 404/6 |
| 5,863,030 | A | 1/1999 | Kolter et al. | |
| 5,993,103 | A | 11/1999 | Christensen | |
| 6,312,188 | B1 * | 11/2001 | Ousterhout | E01F 13/024 256/1 |
| 6,676,113 | B2 | 1/2004 | Christensen et al. | |
| 7,048,467 | B2 * | 5/2006 | Burns | E01F 13/046 404/6 |

(Continued)

*Primary Examiner* — Thomas B Will
*Assistant Examiner* — Katherine J Chu
(74) *Attorney, Agent, or Firm* — Workman Nydegger

(57) ABSTRACT

A barrier system includes a plurality of barriers that can be used to form a barrier wall. Each barrier includes a first panel at least partially bounding a cavity and a first leg assembly supporting the first panel in an elevated position. A plurality of spikes are removably disposed on the first panel. A flexible snare is disposed within the cavity of the first panel, the snare being secured to the plurality of spikes so that when the spikes are removed from the first panel, the snare is drawn away from the first panel by the spikes.

15 Claims, 8 Drawing Sheets

(56) References Cited

U.S. PATENT DOCUMENTS 7,121,760 B1 * 10/2006 Curry, Jr. ..... E01F 13/12 404/6
7,494,112 B2 * 2/2009 Fromm ..... E01F 13/12 256/64
7,540,682 B1 6/2009 Christensen et al.
8,186,905 B2 5/2012 Castro et al.
8,215,866 B2 * 7/2012 Whitford ..... F41H 11/08 256/13.1
8,439,594 B1 * 5/2013 Clark ..... E01F 13/12 256/13.1
8,469,627 B2 * 6/2013 Castro ..... E01F 13/12 404/6
8,596,904 B2 12/2013 Castro et al.
8,905,672 B2 12/2014 Castro et al.
2005/0214071 A1 * 9/2005 Collier ..... E01F 13/12 404/6
2005/0244223 A1 * 11/2005 Shackelford ..... E01F 13/12 404/6
2006/0140715 A1 * 6/2006 Lyddon ..... E01F 13/12 404/6
2007/0183845 A1 * 8/2007 Lewis ..... E01F 13/048 404/6
2008/0271652 A1 * 11/2008 White ..... E01F 13/12 109/49.5
2009/0250674 A1 * 10/2009 Darcy ..... E01F 13/12 256/13.1
2009/0279948 A1 11/2009 Allsopp
2009/0317185 A1 12/2009 Coomber et al.
2010/0178104 A1 * 7/2010 Bare ..... E01F 13/12 404/6
2010/0196092 A1 8/2010 Castro et al.
2010/0284739 A1 11/2010 Allsopp et al.
2011/0029235 A1 3/2011 Berry
2011/0064516 A1 3/2011 Lyddon et al.
2011/0070022 A1 3/2011 Dandy et al.
2011/0097147 A1 4/2011 Castro et al.
2012/0237293 A1 9/2012 McCoy et al.
2013/0078036 A1 3/2013 Castro et al.
2014/0186110 A1 7/2014 Castro et al.
2014/0199118 A1 * 7/2014 Wersching ..... E01F 13/12 404/6
2016/0281307 A1 * 9/2016 Sullivan ..... E01F 13/12
2018/0023263 A1 * 1/2018 Rothschild ..... E01F 13/12 404/6
2018/0106572 A1 * 4/2018 Verdino ..... F41B 3/02

* cited by examiner

COLLAPSIBLE PERIMETER BARRICADE

CROSS-REFERENCE TO RELATED APPLICATIONS

This application claims the benefit of Provisional Application No. 62/423,685, filed Nov. 17, 2016, which for purposes of disclosure is incorporated herein by specific reference.

BACKGROUND OF THE INVENTION

1. The Field of the Invention

The present invention relates to portable perimeter barrier systems having a vehicle restraining device.

2. The Relevant Technology

There are no low-cost, low-weight, easy-to-deploy perimeter barriers for expeditionary environments capable of defeating a vehicle-borne threat while simultaneously deterring dismounted personnel. Today's deployed security solutions employ ineffective, antiquated, brute-force methods that are logistically and fiscally taxing, politically contentious, and/or time consuming to install.

U.S. Department of Defense (DoD) and Department of State (DoS) operations are shifting their focus from conflicts in the Middle East to building partnership with fledgling nations all over the world, specifically on the African continent. These environments, while permissive, still harbor threats from violent extremist organizations (VEO); ongoing advances in physical security technologies are required to mitigate these threats. Finding the correct balance between security, flexibility, and cost has always been challenging, and that challenge is even greater in today's fiscally constrained environment. U.S. personnel are deploying to isolated locations for extended durations; however, they lack the large scale (and expensive) build-up of permanent infrastructure and security. Vehicle-borne improvised explosive devices (VBIED) have served as either an effective single event attack or as a precursor to a larger ground assault in numerous operating environments. Until this currently effective tactic is mitigated, VEOs have no reason to adjust their methodology.

Current military perimeters typically include multiple layers of protection between the threat element and critical resources. In nearly all cases, the outer most perimeter of an expeditionary location is made up of three strands of concertina wire (c-wire), HESCO(R) barriers (filled with dirt), concrete Jersey or Texas style barriers, or large earth berms. In more robust or permanent locations, additional construction may include chain-link fences with K-rated anti-ram cabling integration or permanent steel bollard incased in reinforced concrete. The expeditionary options available to U.S. personnel holds a host of significant issues when current VEO tactics, techniques, and procedures (TTPs) are taken into account.

Triple-strand c-wire, arguably the most prevalent and fastest-to deploy perimeter, is only moderately effective at stopping personnel and almost completely ineffective at stopping a vehicle-borne threat. Its benefits include being inexpensive, light-weight, and discouraging to unmotivated foot traffic from breaching the perimeter. However, the drawbacks that must be considered are significant: the triple-strand c-wire it will not stop most vehicles, it is susceptible to weather fatigue, it takes a large number of personnel several hours to deploy, and it allows for direct observation of activities within the base boundary.

HESCO(R) style dirt-filled barriers are light and inexpensive to pre-position but require heavy machinery to fill quickly and must have access to a significant amount of fill material. Additionally, the fill material must be of a certain type to meet density and ballistic protection characteristics. HESCO(R) barriers are outstanding blast-wave, fragmentary, and direct-fire threat mitigators and are typically used as an inner perimeter closer to high-value resources or personnel.

A significant drawback to the HESCO(R) system is that if a section is damaged or blown out, it takes a considerable amount of time or heavy machinery to replace the compromised area, thus leaving resources or personnel vulnerable. Additionally, several locations where HESCO(R) barriers could be used simply lack the fill materials typically found in environments like Iraq or Afghanistan to leverage them effectively. To employ HESCO(R) barriers in these environments, added cost and time will be required to transport the fill material, thus making them a less-than-ideal barrier solution.

Jersey and Texas style barriers are made out of reinforced concrete and, when anchored or linked, create a strong deterrent to a vehicle-borne threats and mitigates direct observation into the base. The paramount problem with concrete barriers is their weight; transporting prefabricated units via air is cost preventative and surface transport is extremely time consuming. Effective deployment of concrete barriers almost always requires on-site or local area manufacturing facilities; raw material and dependable workforce availability become significant challenges to overcome. Additionally, it takes time for reinforced concrete to cure enough to be effective. A secondary limiting factor to concrete barriers is the fact that they are susceptible to blast fragmentation from nearby explosions. The barrier itself becomes a hazard to resources and personnel in the immediate vicinity of an explosion.

Finally, more robust, permanent solutions are available and often include chain-link style fencing with c-wire affixed to part or all of the fence. To prevent vehicle breaches, K-rated cabling can be integrated into the fence or just inside the base boundary. Compared to c-wire alone, this style of fencing is extremely effective at mitigating a vehicle threat and somewhat more effective against dismounted personnel. The chief criticism of this robust fencing solution is the cost and time it takes to install. K-rated cabling requires concrete anchors buried at regular intervals to maintain their crash rating. In most cases, the chain-link fence must also utilize a concrete foundation so as to prevent drainage or erosion from weakening the perimeter. In modem expeditionary environments this solution, while robust, is simply not cost-effective in most cases. Geopolitical pressures to maintain a limited U.S. military footprint within the boarders of partner nations make large-scale, high-visible construction programs problematic and have the potential to strain important relationships.

In view of the above, new barrier systems are required to meet the challenging and evolving threat in current and future operating environments while maintaining lower cost, lower weight, and/or agile deployment characteristics.

SUMMARY OF THE INVENTION

In one aspect of the invention a barrier system includes:

a first panel at least partially bounding a cavity;

a first leg assembly supporting the first panel in an elevated position;

a plurality of spikes removably disposed on the first panel; and a flexible snare disposed within the cavity of the first panel, the snare being secured to the plurality of spikes so that when the spikes are removed from the first panel, the snare is drawn away from the first panel by the spikes.

In one example, the first panel comprises a body having a front face and an opposing back face that extend between an upper end and an opposing lower end, the cavity being formed on the front face of the body.

In another example, the upper end of the body terminates at an upper end face and the lower end of the body terminates at a lower end face, the body having a maximum length extending between upper end face and the lower end face of at least 1 meter, 1.5 meters, 2 meters or 2.5 meters.

In another example, the front face and the opposing back face of the body extend between opposing side faces, the body having a maximum width extending between the opposing side faces of at least 0.5 meters, 1 meter, 1.5 meters or 2 meters.

In another example, the first panel further comprises a foot outwardly projecting from the front face at the lower end.

In another example, the front face of the body is disposed in an imaginary plane, the first leg assembly supporting the first panel in an elevated position so that the plane is disposed at an inside angle in a range between 85° and 40° with between 80° and 60° being more preferred.

In another example, the leg assembly comprises a pair of legs hingedly mounted to the back face of the body.

In another example, the legs are configured to collapse when a predetermined load is applied to the front face of the body.

In another example, the plurality of spikes are positioned so as to outwardly project from the front face of the body.

In another example, the plurality of spikes are disposed within or adjacent to the cavity of the first panel.

In another example, the plurality of spikes comprise at least 3, 5, 10, 15 or 20 spikes.

In another example, a frangible plate is secured to the first panel, the frangible plate at least partially covering the cavity and the plurality of spikes.

In another an example, the frangible plate fully covers the plurality of spikes and the snare within the cavity.

In another example, the frangible plate is more frangible and/or has a lower tensile strength than the body of the first panel.

In another example, the barrier system further comprises:

a second panel at least partially bounding a cavity;

a second leg assembly supporting the second panel in an elevated position;

a plurality of spikes removably disposed on the second panel; and a flexible snare disposed within the cavity of the second panel, the snare being secured to the plurality of spikes so that when the spikes are removed from the second panel, the snare is drawn away from the second panel by the spikes, wherein the first panel is interlocked with the second panel.

In another example, the snare includes an elongated piece of netting, fabric, woven material, membrane, or film.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
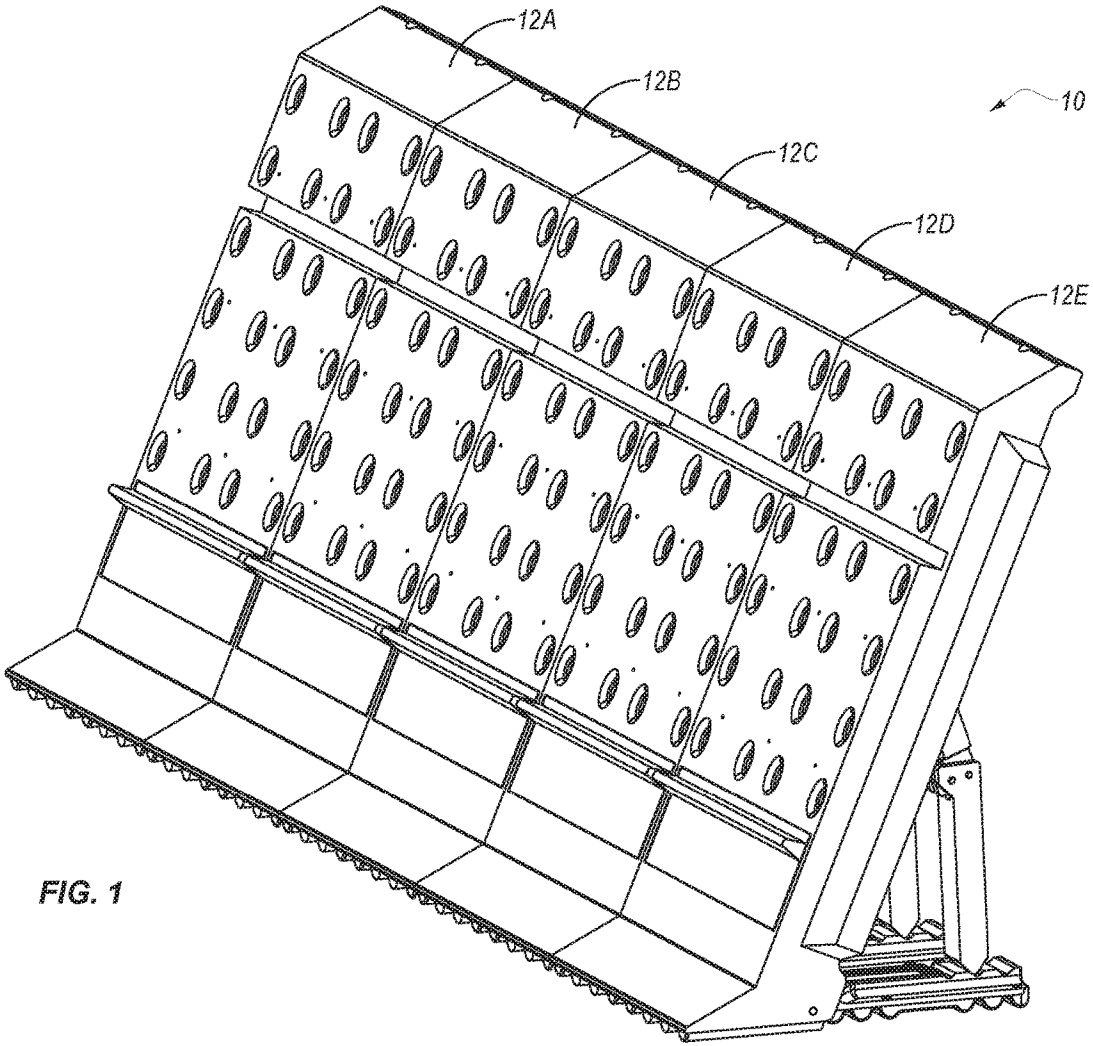
FIG. 1 is a perspective view of a barrier system comprised of a plurality of separate barriers that are adjacently disposed.

Before describing various embodiments of the present disclosure in detail, it is to be understood that this disclosure is not limited to the parameters of the particularly exemplified systems, methods, and/or products, which may, of course, vary. Thus, while certain embodiments of the present disclosure will be described in detail, with reference to specific configurations, parameters, features (e.g., components, members, elements, parts, and/or portions), etc., the descriptions are illustrative and are not to be construed as limiting the scope of the claimed invention. In addition, the terminology used herein is for the purpose of describing the embodiments, and is not necessarily intended to limit the scope of the claimed invention.

Unless defined otherwise, all technical and scientific terms used herein have the same meaning as commonly understood by one of ordinary skill in the art to which the present disclosure pertains.

Various aspects of the present disclosure, including systems, processes, and/or products may be illustrated with reference to one or more embodiments or implementations, which are exemplary in nature. As used herein, the terms "embodiment" and implementation" mean "serving as an example, instance, or illustration," and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

It will be noted that, as used in this specification and the appended claims, the singular forms "a," "an" and "the" include plural referents unless the context clearly dictates otherwise. Thus, for example, reference to a "bristle" includes one, two, or more bristles. Similarly, reference to a plurality of referents should be interpreted as comprising a single referent and/or a plurality of referents unless the content and/or context clearly dictate otherwise. Thus, reference to "bristles" does not necessarily require a plurality of such bristles. Instead, it will be appreciated that independent of conjugation; one or more bristles are contemplated herein.

As used herein, directional terms, such as "top," "bottom," "left," "right," "up," "down," "upper," "lower," "proximal," "distal" and the like are used herein solely to indicate relative directions and are not otherwise intended to limit the scope of the disclosure and/or claimed invention.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated. Furthermore, binding, coupling, attaching, connecting, and/or joining can comprise mechanical and/or chemical association.

To facilitate understanding, like reference numerals (i.e., like numbering of components and/or elements) have been used, where possible, to designate like elements common to the figures. Specifically, in the exemplary embodiments illustrated in the figures, like structures, or structures with like functions, will be provided with similar reference designations, where possible. Specific language will be used herein to describe the exemplary embodiments. Nevertheless, it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential). Furthermore, multiple instances of an element and or sub-elements of a parent element may each include separate letters appended to the element number. Furthermore, an element label with an appended letter can be used to designate an alternative design, structure, function, implementation, and/or embodiment of an element or feature without an appended letter. Likewise, an element label with an appended letter can be used to indicate a sub-element of a parent element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where multiple possibilities of values or a range a values (e.g., less than, greater than, at least, or up to a certain value, or between two recited values) is disclosed or recited, any specific value or range of values falling within the disclosed range of values is likewise disclosed and contemplated herein.

The headings used herein are for organizational purposes only and are not meant to be used to limit the scope of the description or the claims.

Reference will now be made the figures of the present disclosure. It is noted that the figures are not necessarily drawn to scale and that the size, orientation, position, and/or relationship of or between various components can be altered in some embodiments without departing from the scope of this disclosure.

Depicted in FIG. 1 is one embodiment of an inventive barrier system 10 incorporating features of the present invention. In general, barrier system 10 comprises a plurality of discrete barriers 12A-12E that are interlocked together or are otherwise adjacently positioned side-by-side so as to form a barrier wall. As discussed below in greater each barrier 12 comprises a vehicle restraining device that can be used to restrain a vehicle, such as a car, truck, motorcycle, or the like, that attempts to drive over barrier system 10. Barrier system 10 thus provides a physical barrier wall that marks a boundary and helps prevent or restrict access and provides a vehicle restraining device that restrains vehicles that may attempt to break through the barrier wall.

It is appreciated that barrier system 10 can be used in a variety of different ways. For example, in one embodiment barrier system 10 can be used by the military to form a perimeter barrier around a military outpost, secure location, or other facility. Because barrier system 10 is relatively lightweight, easily transportable, and easily assembled, barrier system 10 is particularly well suited for forming a perimeter barrier about temporary or mobile facilities but can also be used at more permanent facilities. Barrier system 10 can also be used in non-military applications where it is desired to restrain public access and prevent vehicle access. For example, barrier system 10 can be used at sporting events, concerts, outdoor exhibits, construction zones, demonstrations, and at other locations where it is desired to restrain or limit access.

In view of the foregoing, it is appreciated that barrier system 10 when deployed may comprise any desired number of barriers 12 that are interlocked or adjacently disposed and that barriers 12 can be placed in any desired orientation. For example, the number of barriers 12 in a barrier wall may comprise at least or less than 5, 10, 15, 20, 30, 40, 50, 75, 100, or 200 barriers or a range between any two of the foregoing. In addition, barriers 12 can be placed linearly, along a defined path or in a continuous loop such as a circle, oval, square, or some irregular shape. Other numbers of barriers or layouts for the barriers can also be used.

Figure 2:
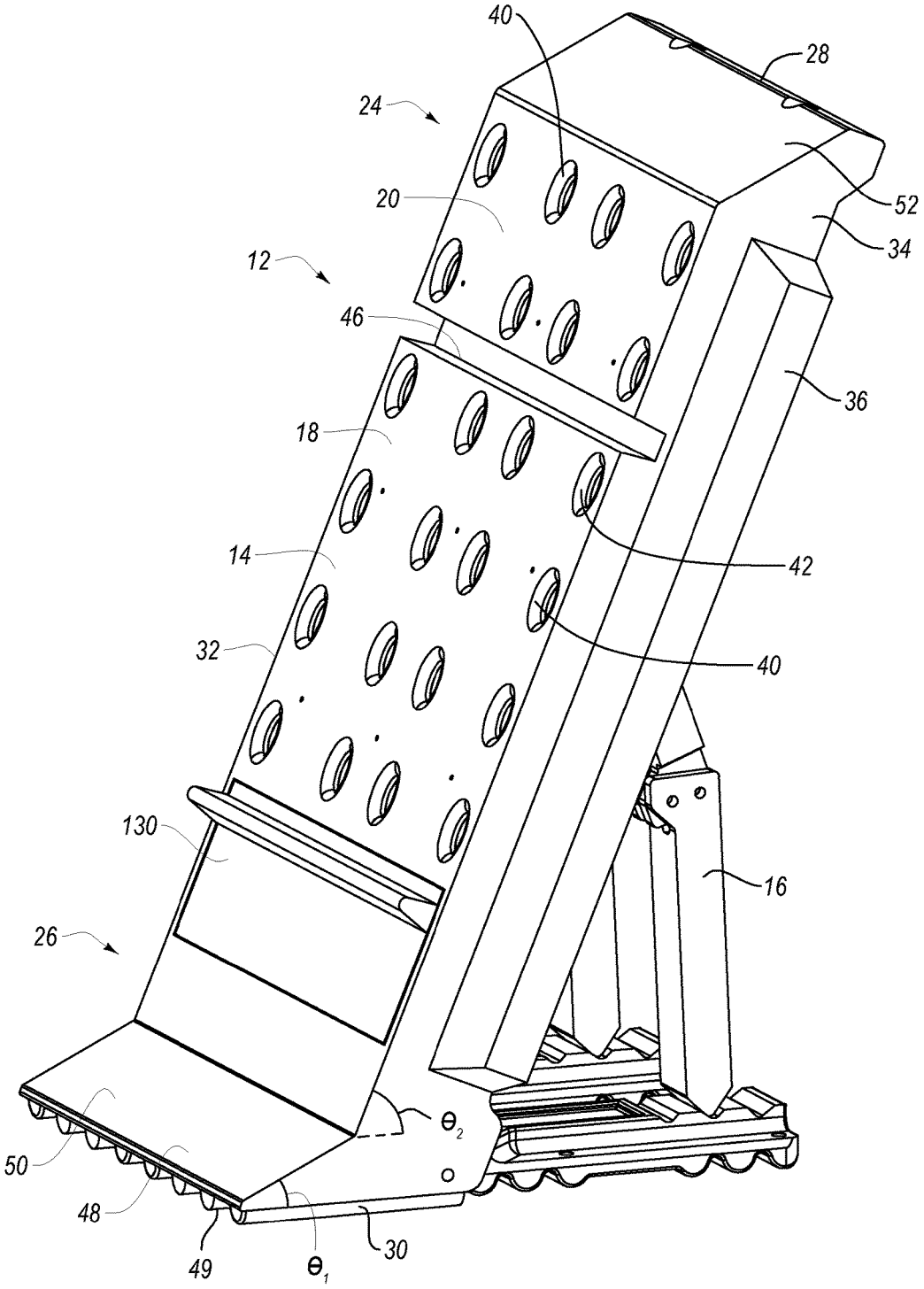
FIG. 2 is a front perspective view of one of the barriers shown in FIG. 1.
Figure 3:
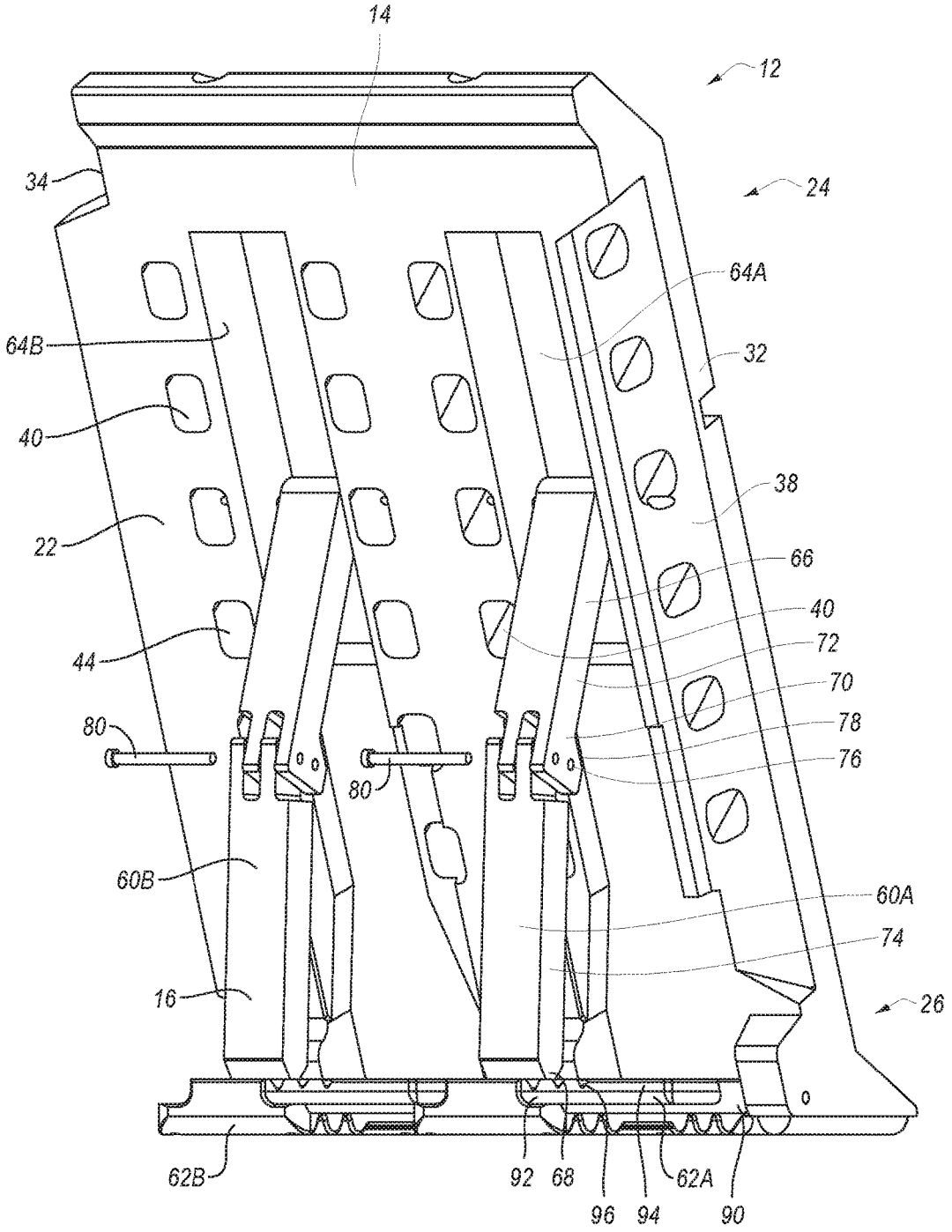
FIG. 3 is a rear perspective view of the barrier shown in FIG. 2.

As depicted in FIGS. 2 and 3, each barrier 12 comprises a panel 14 that can be selectively supported in an elevated position by a leg assembly 16. Each panel 14 comprises an elongated body 18 having front face 20 and an opposing back face 22 that longitudinally extend between an upper end 24 and opposing lower end 26. Upper end 24 terminates at an upper end face 28. While lower end 26 terminates at a lower end face 30. Front face 20 and back face 22 also extend between opposing side faces 32 and 34. Outwardly projecting alongside side face 34 is an elongated tongue 36. A complementary groove 38 is formed along the length of side face 32. As such, when barriers 12 are adjacently disposed as depicted in FIG. 1, tongue 36 of one barrier is received within groove 38 of adjacent barrier 12 to assist in interlocking barriers 12 together.

In one embodiment of the present invention means are provided for interlocking barriers 12 together. One example of such means includes tongue 36 and groove 38 which interlock as depicted and discussed above. In alternative embodiments, tongue 36 and groove 38 can have a variety of different configurations. For example, in contrast to having one single elongated tongue that is received within a single corresponding groove, tongue 36 could be in the form of a plurality of short posts or other projections that are received within corresponding sockets or other corresponding recesses. Any other tongue and groove configurations could also be used. In still other embodiments, the means for interlocking could be accomplished by clasps, clamps, fasteners, Velcro, i.e., hook and loop material, and any other kinds of mechanical connectors or fasteners that can be used to interlock barriers 12 together.

In one embodiment, body 18 has essentially a rectangular configuration having a maximum length extending between upper end face 28 and lower end face 30 that is at least or is less than 1 meter, 1.5 meters, 2 meters, 2.5 meters, or 3 meters, or is in a range between any two of the foregoing. Likewise, body 18 has a width extending between opposing side faces 32 and 34 that is at least or is less than 0.5 meters, 1 meter, 1.5 meters or 2 meters or is in a range between any two of the foregoing. Finally, body 18 typically has a maximum thickness extending between front face 20 and back face 22 that is at least or is smaller than 10 centimeters, 15 centimeters, 20 centimeters, 25 centimeters, 30 centimeters, or 40 centimeters or in a range between any two of the foregoing. Other dimensions for the above can also be used. Panel 14 is typically molded from a polymeric material such as high-density polyethylene or linear low-density polyethylene. However, other materials can also be used. Molding can be accomplished through injection molding, rotational molding, blow molding, or other molding processes.

Although not required, in one embodiment to add stability and strength to panel 14, a plurality of kiss-offs 40 are formed between front face 20 and back face 22. That is, panel 14 is molded so that panel 14 is largely hollow between front face 20 and back face 22. Kiss-offs 40 are formed during the molding process by causing a portion of front face 20 and back face 22 to inwardly project so that they contact centrally within panel 14 and thereby melt or fuse together. A plurality of spaced apart kiss-offs 40 are formed that help prevent outward flexing or inward bowing of front face 20 and back face 22 and also provide structural strength of faces 20 and 22 and to the overall panel 14. As a result of kiss-offs, a plurality of corresponding sockets 42 are formed on front face 20 while a corresponding plurality of sockets 44 are formed on back face 22 with kiss-offs 40 being formed between adjacent sockets 42 and 44. As will be discussed below in greater detail, an elongated recess 46 is also formed on front face 20 and laterally extends between opposing side faces 32 and 34 at or towards upper end 24.

Figure 7:
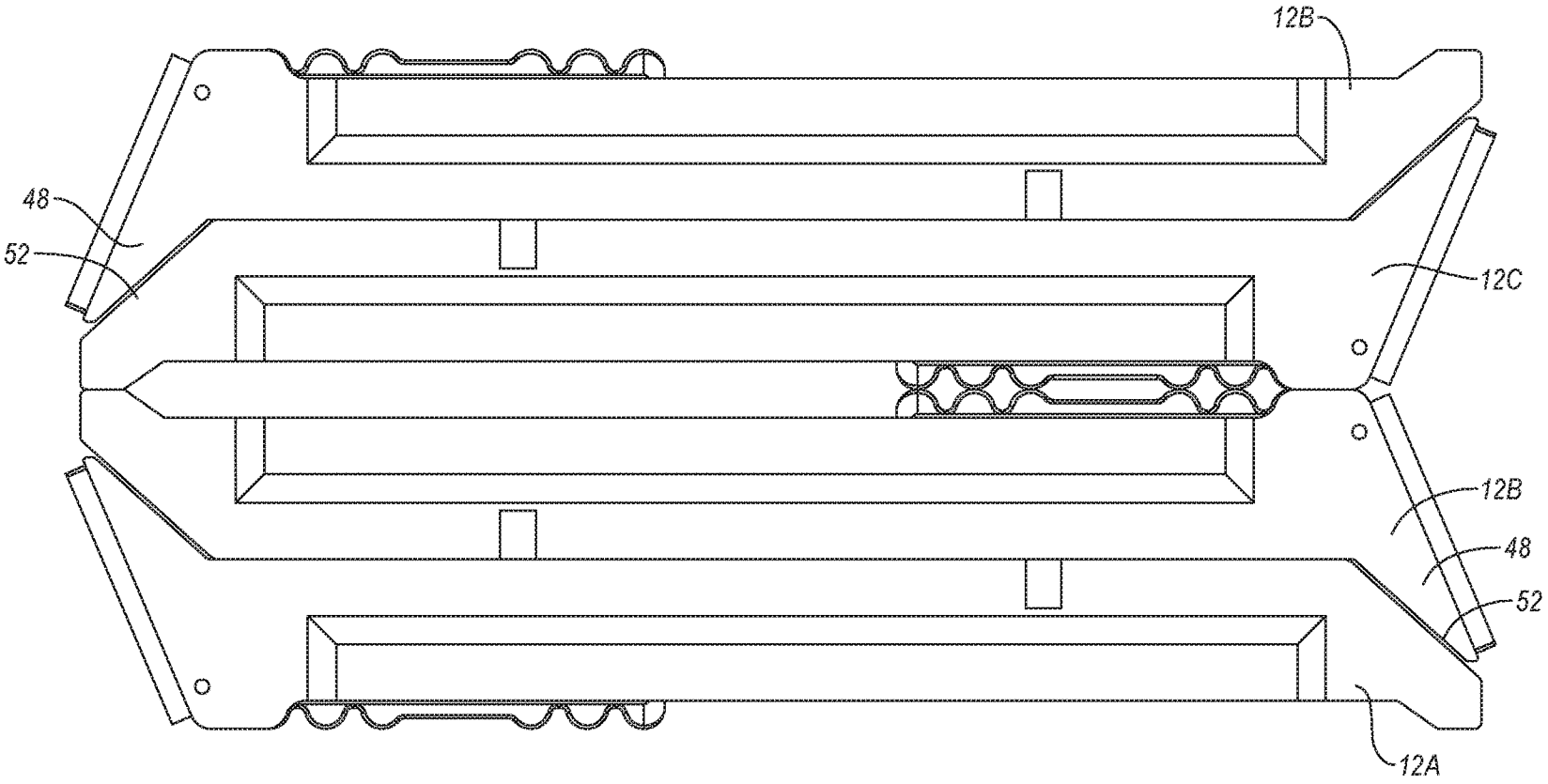
FIG. 7 is an elevated side view of the barriers shown in FIG. 2 stacked with the legs in a retracted position.

As depicted in FIG. 2, panel 14 can further comprises a foot 48 that outwardly projects from front face 20 at lower end 36 and commonly outwardly projects from lower end face 30. Foot 48 has a bottom surface 49 and an opposing top surface 50. Top surface 50 typically slopes upwards toward body 18. In one embodiment, the angle $\theta_1$ between bottom surface 49 and top surface 50 is in a range between 20 degrees to 70 degrees with between 30 degrees and 60 degrees being more common. Other angles can also be used. In alternative embodiments, foot 48 can have different configurations or can be eliminated. Where foot 48 is used, a tapered face 52 can be formed at upper end 24 of front face 20 adjacent to upper end face 28. Tapered face 52 can have an angle complementary to the angle of top surface 50 of foot 48 so that when barriers 12 are stacked together, as discussed below in more detail and as depicted in FIG. 7, foot 48 can be disposed against to tapered face 52 so as to enable barriers 14 to lay substantially flat.

Turning to FIG. 3, in this embodiment leg assembly 16 comprises a first leg 60*a* and a second leg 60*b* that are supported on a first platform 62*a* and a second platform 62*b*, respectively. Recessed along the length of back face 22 is a first channel 64*a* and a laterally spaced apart second channel 64*b*. Each leg 60 has a first end 66 that is hingedly secured within a corresponding channel 64 and an opposing second end 68 that is shown freely resting on a corresponding platform 62. A hinge 70 is centrally formed on each leg 60 and divides each leg 60 into an upper leg portion 72 and a lower leg portion 74. Hinge 70 includes a fixed pin 76 that hingedly secures upper leg portion 72 to lower leg portion 74. Hinge 70 also include a pin hole 78 that extends through a portion of upper leg portion 72 and lower leg portion 74 and which is configured to receive a frangible pin 80. When frangible pin 80 is received within pin hole 78, upper leg portion 72 and lower leg portion 74 are rigidly held together. In one embodiment, legs 60 can be made from a polymer, such as the same polymers used to produce panel 14, as discussed above. However, in other embodiments where greater strength or other properties are desired, legs 60 can be made from metals, composites, other materials or combinations of the foregoing.

Figure 4:
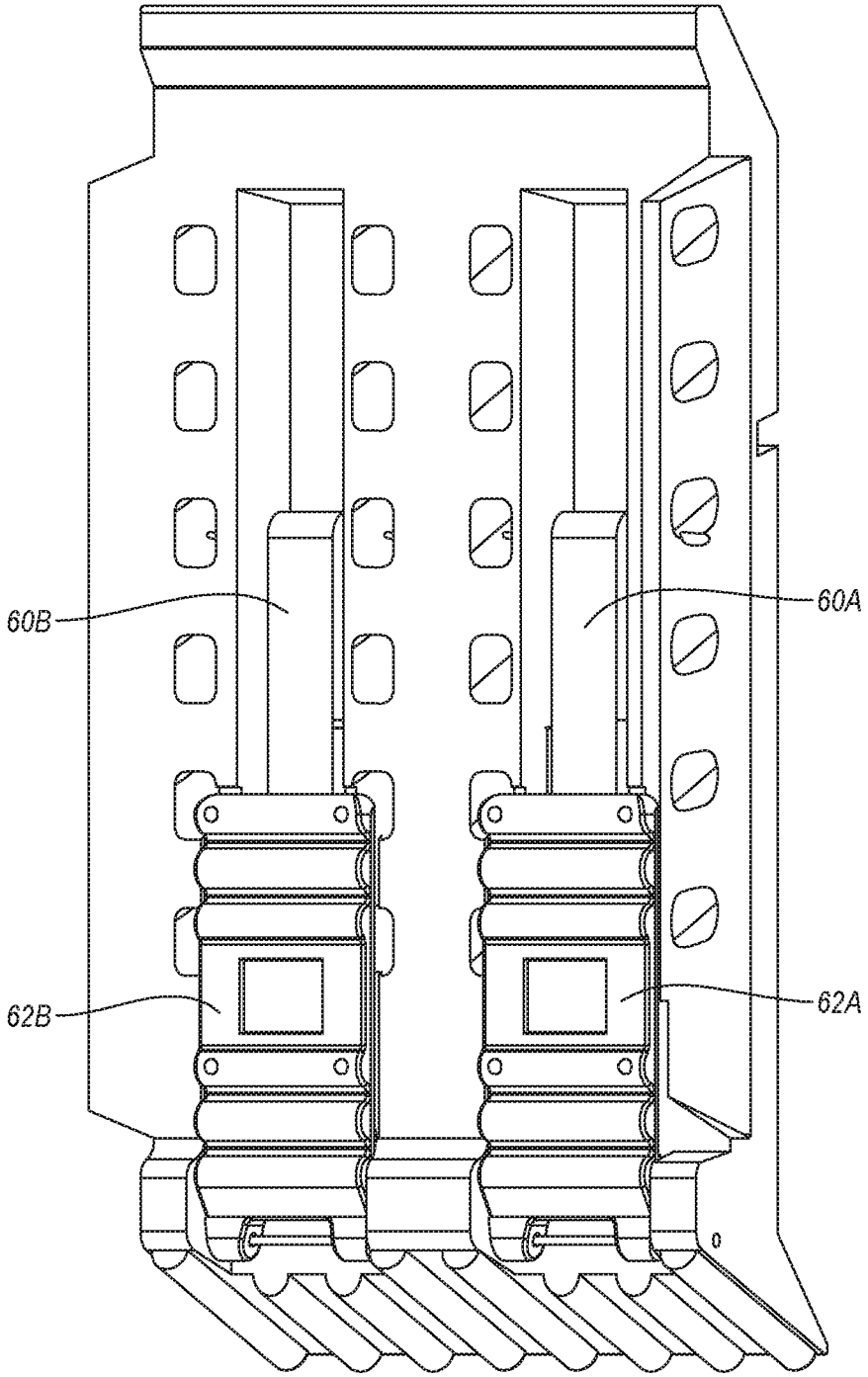
FIG. 4 is a rear perspective view of the barrier shown in FIG. 3 with the legs in a retracted position.

Each platform 62 has a first end 90 that is hingedly disposed within a corresponding channel 64 at lower end 26 and a freely disposed second end 92. A top surface 94 extends between ends 90 and 92. A plurality of space apart retention grooves 96 are recessed on top surface 94 at or toward second end 92. Each platform 62 can be selectively rotated between a retracted position, as depicted in FIG. 4, wherein platforms 62 are received within a corresponding channel 64 or are otherwise disposed flush against back face 22 and an extended position, as depicted in FIG. 3, wherein platforms 62 fold out to rest upon a ground surface. Each leg 60 also moves between a retracted position, as shown in FIG. 4, wherein legs 60 are received within channel 64 and an extended position, as shown in FIG. 3, wherein legs 60 pivot outward so that second ends 68 of legs 60 rest on top surface 94 of corresponding platforms 62.

For example, during transport and storage, legs 60 and platforms 62 are typically placed in the retracted positions so that each barrier 12 is substantially flat. By reversing and/or inverting adjacent barriers 12, as depicted in FIG. 7, barriers 12 can be easily stacked horizontally in a compact nesting configuration. This stacking configuration makes it easy and efficient to store and transport barriers 12. When it is desired to erect barriers 12, panel 14 is raised in a generally vertical orientation and platforms 62 and legs 60 are moved from their retracted position to their extended position. Depending upon the desired orientation for panels 14 second end 68 of legs 60 are received within a desired retention grooves 96 so that legs 60 are securely held in position. Either prior to, during, or after moving legs 60 to the extended position, frangible pins 80 are received within pin hole 78 so that legs 60 are rigid.

As depicted in FIG. 2, with legs 60 in the extended position, front face 20 of panel 14 is disposed in a vertically reclined position. Specifically, front face 20 is either planer or is disposed within a plane. The inside angle $\theta_2$ between the planer face or plane of front face 20 relative to the horizontal is typically in a range between 85 degrees and 45 degrees with between 75 degrees and 55 degrees being more common. Other angles can also be used.

Figure 5:
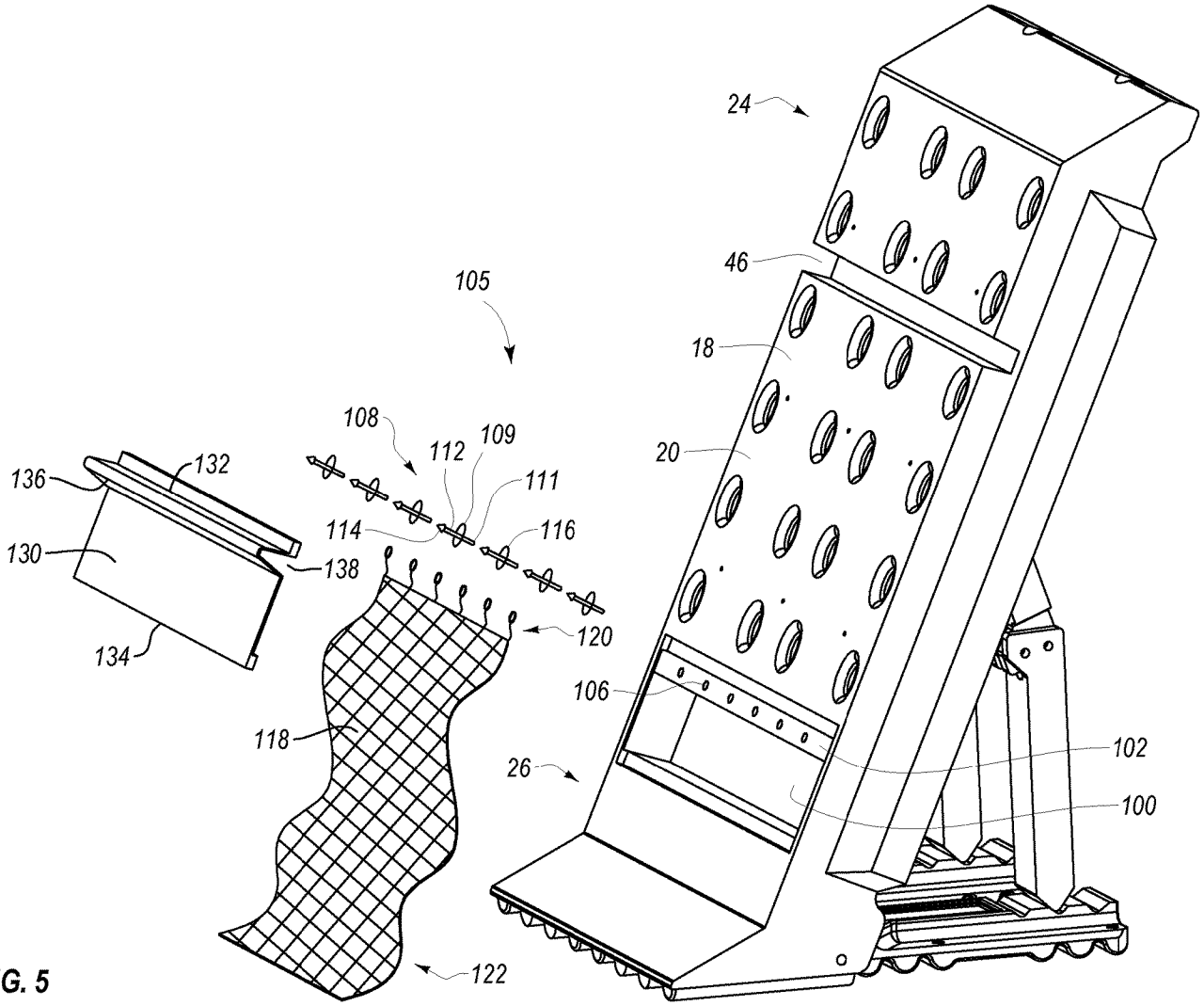
FIG. 5 is a front perspective view of the barrier shown in FIG. 2 with the vehicle restraining device thereof in an exploded configuration.

As previously mentioned, the inventive barrier system 10 also includes a vehicle restraining device 105 which is also referred to herein as a means for restraining a vehicle. By way of example and not by limitation, as depicted in FIG. 5, a cavity 100 is formed on front face of body 18 at lower end 26. Disposed within or adjacent to cavity 100 is a support 102. Support 102 is typically comprised of metal but can also be formed of other materials. In the depicted embodiment, support 102 comprises a channel formed of metal. The channel could be tubular, U-shaped or C-shaped. In other embodiments, support 102 could comprise a plate or other structure. Support 102 has a top surface 104 having a plurality of space openings 106 formed thereon. A plurality of separate spikes 108 are also provided. Each spike 108 comprises a shaft 109 having a first end 110 that is received within a corresponding opening 106 on support 102 and an opposing second end 112 where a sharpened barb 114 is located. A flange 116 outwardly projects from shaft 109 at a location between opposing ends 110 and 112. Flange 116 is shown encircling shaft 109 but in other embodiments need not completely encircle shaft but could project out from one or more sides of shaft 109. The number of spikes 108 used can depend on the application. In one embodiment, the number of spikes 108 disposed on support 102 can comprise at least or less than 1, 3, 5, 7, 10, 15 or 20 spikes or be in a range between any two of the foregoing. Other numbers of spikes 108 can also be used.

Vehicle restraining device 105 also includes an elongated snare 118. Snare 118 comprises an elongated piece of flexible material that can wrap and twist around a tire and/or axle of a vehicle so as to stop the vehicle. Snare 118 typically comprises a piece of flexible material such as netting, fabric, woven material, membrane, or film. Snare 118 needs to have sufficient strength that it can twist and wrap around a tire and/or axle for stopping the tire without simply breaking or tearing into pieces. In part, the strength of the material used for snare 118 depends on the length of snare 118. That is, longer snares that are intended to wrap around a tire multiple times can have a lower strength relative to shorter snares 118. Examples of fibers that could be used in a netting or fabric for snare 118 include aramid fibers such as Kevlar™. Other high strength synthetic and natural fibers could also be used.

Snare 118 is folded, coiled or otherwise position within cavity 100. Snare 118 has a first end 120 and an opposing second end 122. The length of snare 118 between ends 120 and 122 is typically at least 1 meter, 1.5 meters, 2 meters, 2.5 meters, 3 meters or in a range between any two of the foregoing. Snare 118 also has a width that is typically at least 0.1 meter, 0.2 meter 0.3 meter, 0.4 meter, 0.5 meter, 0.7 meter, 1 meter or in a range between any two of the foregoing. First end 120 of snare 118 is secured to each spike 108 at spaced apart locations along the width of first end 120. In one embodiment, this is accomplished by a plurality of lanyards 124 that are secured to second end 120 of snare 118 along the width thereof. Each lanyard 124 has a loop 125 formed at the end thereof is passed over second end 112 of each spike 108 so as to rest on flange 116. Flange 116 has a dimension larger than the opening extending through loop 125 or is otherwise dimensioned so as to prevent flange 116 from passing through loop 125.

In other embodiments, lanyards 124 can be eliminated and first end 120 of snare 118 can be secured directly to spikes 108 by passing portions of snare over spikes 108. In still other embodiments, snare 118 or lanyards 124 extending from snare 118 can be secured to spikes 108 by tying the two together or by using crimps, clamps, screws, or other mechanical fasteners or by using other conventional attachment mechanisms. Depending on the embodiment, it is appreciated that flange 116 can be eliminated from spikes 108 when flange 116 is replaced with other attachment mechanisms for snare 118. Spikes 108 can either be releasably attached to snare 118 or can be permanently fixed to snare 118.

Figure 6:
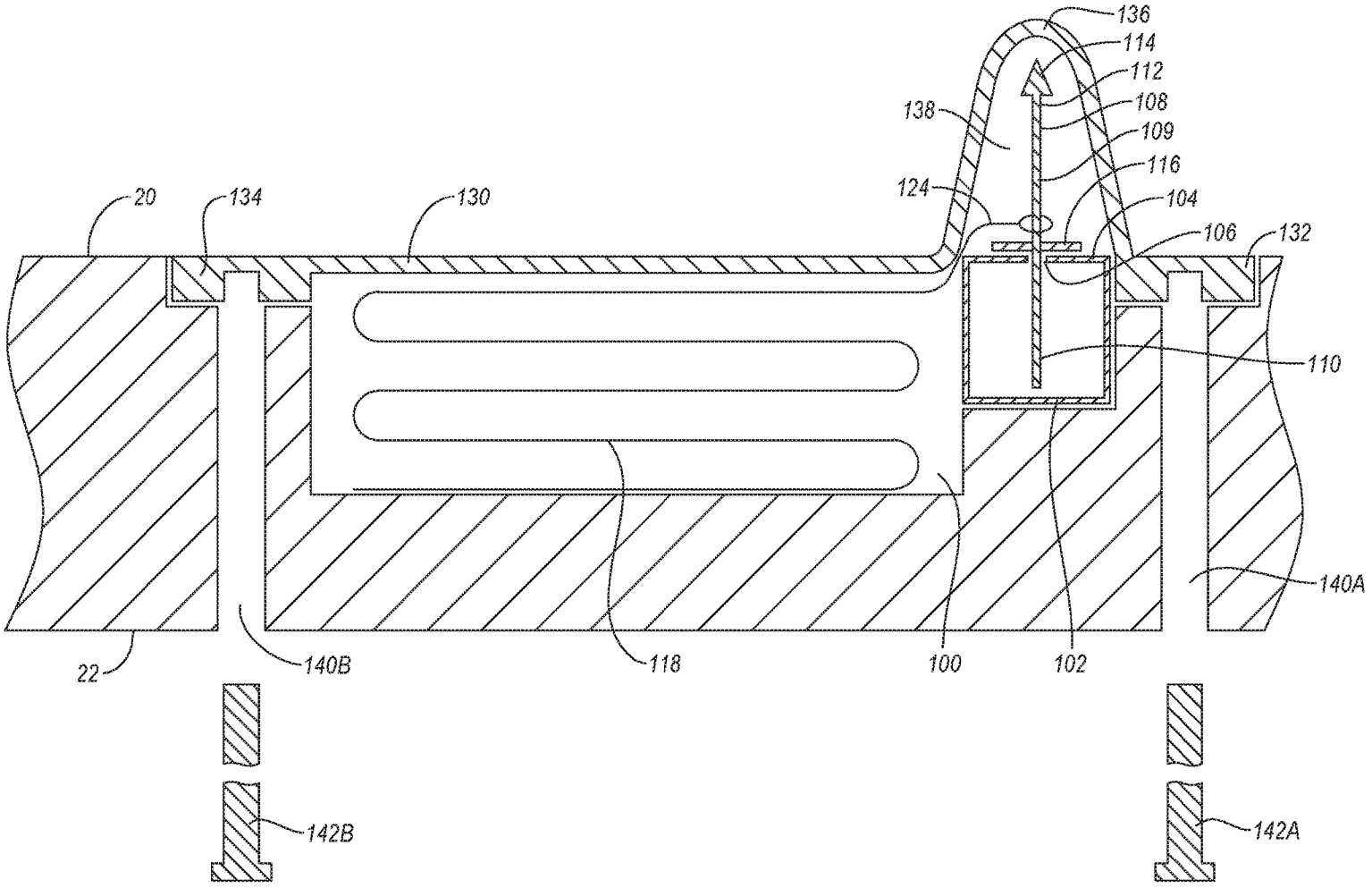
FIG. 6 is a cross sectional side view of the vehicle restraining device shown in FIG. 5 in an assembled configuration.

With snare 118 and spikes 108 positioned and assembled as discussed above, a frangible cover 130 is mounted to panel 14 so as to cover snare 118 and spikes 108. Specifically, panel 118 has a first end 132 and opposing second end 134 with a rib 136 that outwardly projects and extends laterally between opposing edges of cover 130. Rib 136 has an interior surface that bounds a recess 138. As depicted in FIG. 6, during assembly cover 130 is positioned over cavity 100 so that spikes 108 are received within recess 138 of cover 130. Bolt holes 140*a* and 140*b* extend through panel 14 between front face 20 and back face 22. One, two, or more bolt holes 140*a* communicates with first end 132 of cover 130 while one, two, or more, bolt holes 140*b* communicates with second end 134 of cover 130. Bolts 142*a* and 142*b* can be passed through bolt holes 140*a* and 140*b*, respectively, and screwed into first end 132 and second end 134, respectively, of cover 130 so as to thereby removably secure cover 130 to panel 14. In this configuration, spikes 108 are covered so as to both prevent accidental injury by somebody contacting spikes 108 and to help retain spikes 108 in their desired position.

Cover 130 also covers snare 118 so as to help retain snare 118 in its desired position. Cover 130 also helps to prevent deterioration of snare 118 by exposure to environmental factors and helps prevent foreign matter such as dirt, leaves, sand, garbage, or the like from accumulating within cavity 100 and potentially obstructing the operation of snare 118 and/or spikes 108. Cover 130 is configured so that when barriers 12 are stacked as depicted in FIG. 7, rib 136 (FIG. 5) can be received within recess 46 of the adjacent barrier 12 so that the barriers 12 can nested is a substantially horizontal position.

Because cover 130 is frangible and intended to fail, as discussed below, cover 130 is typically made of material that is different from the material of panel 14. Furthermore, the material of cover 130 is typically more brittle and/or has lower tensile strength than the material of panel 14. In other embodiments, the materials of cover 130 and panel 14 could be the same or different but cover 130 is thinner than the thickness of panel 14 and/or is produced with perforations or other weaknesses that are intended to cause relatively easy failure of cover 130 when struck by a large object, such as a vehicle.

During operation, barriers 12 are placed in a desired position to form a barrier wall. Barriers 12 can be interlocked together or simply be adjacently disposed. If a vehicle attempts to drive through the barrier wall, frangible pins 80 (FIG. 3) are designed to fail due to the initial impact of the vehicle against barriers 12. Once frangible pins 80 fail, legs 60 fold and collapse so that barriers 12 is lying substantially flat on the ground. As the front or rear wheels of the vehicle travel on front face 20 of barrier 12 over frangible cover 130 (FIG. 6), the weight of the vehicle causes cover 130 to fail, i.e., break apart. In addition, as the front or rear wheels of the vehicle pass over spikes 108, spikes 108 penetrate into the wheels and are retained therein by barbs 114. As the front wheels continue to travel, spikes 108 are pulled out of support 102 and move concurrently with the front or rear wheels. Furthermore, because snare 118 is attached to spikes 108, either directly or indirectly as discussed above, snare 118 is drawn out of cavity 100 by being pulled by spikes 108. As the front wheels of the vehicle rotate, snare 118 progressives wraps and twists around the front or rear wheels and/or axle.

Snare 118 is sufficiently large and strong that snare 118 will also bind around the adjacent axle of the vehicles and/or bias against the underside of the carriage of the vehicle so as to halt rotation of the front wheels and thus bring the vehicle to a stop. It is appreciated the barriers 12 are sized to that separate vehicle restraining device 105 from different barriers 12 will typically be used to separately stop the front or rear wheels. Furthermore, in some embodiments a strike plate may be secured to front face 20 of panel 14 above cavity 100 where a vehicle would strike panel 14. The strike plate can be comprised of metal, ceramic, composite or other materials and is used to increase the structural strength of panel 14 so that panel 14 can be reused after being struck by a vehicle. Further examples, details, and alternatives for vehicle restraining devices that can be used in the present invention are disclosed in U.S. Pat. Nos. 8,905,672 and 8,469,627 and US Patent Publication No. 2011/0064516 which are incorporated herein by specific reference.

One of the benefits of the present invention is that barriers 12 can be reused even after vehicle restraining devices 105 has been deployed. For example, the failed frangible pin 80 and frangible cover 130 can be replaced. Likewise, spikes 108 and snare 118 can be also replaced or in some situations reused. The remainder of barrier 12, however, can typically be reused without repair or modification. As such, even after vehicle restraining device 105 has been deployed, barrier system 10 can typically be easily and quickly re-erected into full operational condition.

Figure 8A:
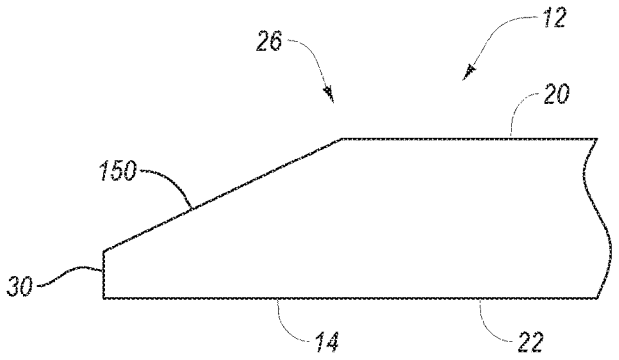
FIGS. 8A and 8B are elevated side views of the lower end of alternative embodiments of the barrier shown in FIG. 2.

In one embodiment, barriers 12 can be designed to help assist the front wheels of a vehicle to drive on top of front face 20 of barrier 12 as or after barrier 12 has been knocked to the horizontal position. This design helps to ensure that the vehicle drives over barriers 12 as opposed to simply knocking barriers out of the way. In one embodiment, feet 48 of barriers 12 are sufficiently long so that the front wheels of the vehicle are at least partially on top of feet 48 while barrier 12 is being moved to the horizontal position. In such an embodiment, feet 48 may have a projecting length of at least 0.25 meters, 0.5 meters, 0.75 meters, 1 meter or longer or in a range between any two of the forgoing values. Other dimensions can also be used. In another embodiment, as depicted in FIG. 8A, foot 48 can be eliminated and a tapered face 150 can be formed at lower end 26 of panel 14 extending from front face 20 to either back face 22 or lower end face 30. Tapered face 150 functions as a ramp to assist the vehicle in driving onto front face 20 and thus onto frangible cover 130.

Figure 8B:
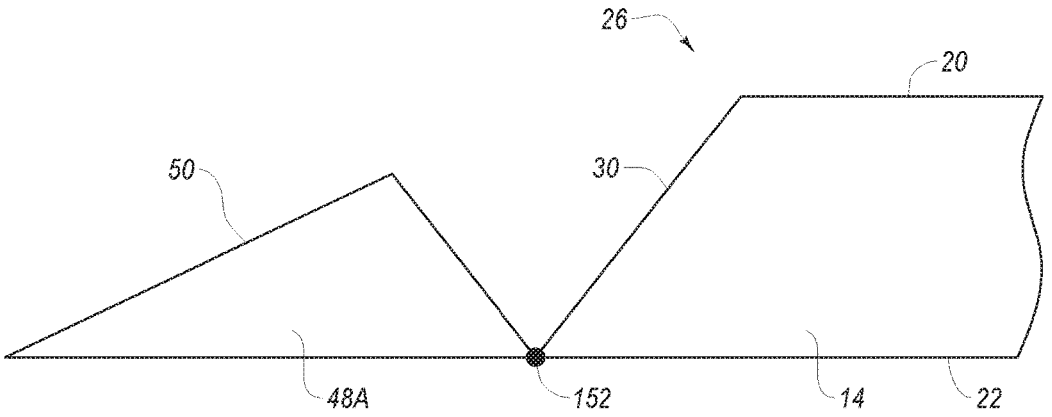

In another embodiment as depicted in FIG. 8B, a foot 48A can be provided where panel 14 is pivotably attached to foot 48A by a hinge 152 at lower end 26. Thus, even when panel is knocked or otherwise moved to a horizontal position, top surface 50 of foot 48A acts as a ramp to assist a vehicle wheel in traveling onto front surface 20 of panel 14 and thus onto frangible cover 130. Other designs can also be used.

In addition, although the present application discloses legs 60 with frangible pins 80 as one configuration of collapsible legs, it is appreciated legs 60 could be replaced with a variety of other configurations. For example, in contrast to having a hinge which uses frangible pin 80, a leg could be used with no central hinge by simply a frangible central section that fails when a vehicle strikes barriers 12. In this embodiment, the entire leg would be replaced between different uses. In another embodiment hinge 70 (FIG. 3) that uses frangible pin 80 could be replaced with a hinge that collapses or folds when a predefined load is applied but does not require the failure of a pin. A variety of other configurations could also be used to produce collapsible legs.

In view of the above, barrier system 10 provides protection from vehicle penetration as well as serves as a deterrent for personnel. It is also significantly lighter, less expensive, and easier to deploy than other engineered options. Specifically designed to absorb and redistribute the force of an attempted breach, barrier system 10 is actually engineered to give-way and collapse when struck by a vehicle traveling at a certain velocity. As the vehicle passes over the barrier system 10, vehicle restraining device 105 is deployed to catch the vehicle, thus preventing it from moving and penetrating further. By absorbing the threat rather than trying to stop it with brute force, the potential for a VBIED to detonate on impact is lessoned. While that section of the perimeter is compromised, the modular nature of the barrier system 10 allows for expedited recovery and replacement of the damaged sections once the current threat is neutralized.

The barriers of barrier system 10 are specifically engineered to be hardened enough to handle high winds and other environmental considerations, such as sand/dust, humidity, and UV degradation. They are also engineered to dissuade dismounted threats from easily defeating the perimeter. When deployed barrier system 10 will create a wall approximately 2 meters high presented at a slight angle which can be used with c-wire outriggers or additional modular attachments making the entire deployed barrier system 10 taller. Additional options might include an integrated intrusion detection and annunciator system, integrated small-arms ballistic protection, mounting positions for ground-based radar and/or long range thermal imaging or CCTV systems, or less-lethal weapon positions.

Barrier system 10 can be sized to fit and stack easily on standard U.S. Air Force 463L pallets for expedited deployment on C-17 or C-130 type aircraft. Because these barriers are designed to absorb impact, heavy or bulky materials are not required for construction supporting ease-of-transport and will be able to fold and/or nest to support shipping on pallets or in containers for rapid transport. In one embodiment, barriers 12 can each be secured in position by grounding stakes. Each barrier system 10 can be tailored to the operating environment in which it will be used with respect to the length of grounding stakes. Depending upon soil material and density, different sized stakes can be included. To speed deployment even more, an optional support pallet can be included and will house a small generator and a customized electric jackhammer to significantly lower the time needed to place the grounding stakes.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A barrier system comprising:

a first panel at least partially bounding a cavity, the first panel comprising a body having a front face and an opposing back face that extend between an upper end and an opposing lower end, the cavity being formed on the front face of the body;

a first leg assembly configured to support the first panel in an elevated position, the first leg assembly comprising at least one leg hingedly mounted to the back face of the body;

a plurality of spikes removably disposed on the first panel; and a flexible snare at least partially disposed within the cavity of the first panel, the snare being secured to the plurality of spikes so that when the spikes are removed from the first panel, the snare is drawn away from the first panel by the spikes.

2. The barrier system as recited in claim 1, wherein the upper end of the body terminates at an upper end face and the lower end of the body terminates at a lower end face, the body having a maximum length extending between the upper end face and the lower end face of at least 1 meter.

3. The barrier system as recited in claim 1, wherein the front face and the opposing back face of the body extend between opposing side faces, the body having a maximum width extending between the opposing side faces of at least 0.5 meters.

4. The barrier system as recited in claim 1, wherein the first panel further comprises a foot outwardly projecting from the front face at the lower end.

5. The barrier system as recited in claim 1, wherein the front face of the body is disposed in a plane, the first leg assembly supporting the first panel in an elevated position so that the plane is disposed at an inside angle in a range between 85° and 40° relative to horizontal.

6. The barrier system as recited in claim 1, wherein the at least one leg comprises a pair of legs hingedly mounted to the back face of the body.

7. The barrier system as recited in claim 6, wherein the legs are configured to collapse when a predetermined load is applied to the front face of the body.

8. The barrier system as recited in claim 1, wherein the plurality of spikes are positioned so as to outwardly project from the front face of the body.

9. The barrier system as recited in claim 1, wherein the plurality of spikes are disposed within or adjacent to the cavity of the first panel.

10. The barrier system as recited in claim 1, wherein the plurality of spikes comprise at least 5 spikes.

11. The barrier system as recited in claim 1, further comprising a frangible plate secured to the first panel, the frangible plate at least partially covering the cavity and the plurality of spikes.

12. The barrier system as recited in claim 11, wherein the frangible plate fully covers the plurality of spikes and the snare within the cavity.

13. The barrier system as recited in claim 11, wherein the frangible plate is more frangible and has a lower tensile strength than the body of the first panel.

14. The barrier system as recited in claim 1, further comprising:

a second panel at least partially bounding a cavity;

a second leg assembly supporting the second panel in an elevated position;

a plurality of spikes removably disposed on the second panel; and a flexible snare disposed within the cavity of the second panel, the snare being secured to the plurality of spikes so that when the spikes are removed from the second panel, the snare is drawn away from the second panel by the spikes, wherein the first panel is interlocked with the second panel.

15. The barrier system as recited in claim 1, wherein the snare comprises an elongated piece of netting, fabric, woven material, membrane, or film.

* * * * *